US006501360B2

(12) United States Patent
Martagni et al.

(10) Patent No.: US 6,501,360 B2
(45) Date of Patent: Dec. 31, 2002

(54) IGNITION COIL FOR VEHICLES

(75) Inventors: Enrico Martagni, Portile (IT); Gabriele Poletti, Carpi (IT); Giorgio Bernardi, Modena (IT)

(73) Assignee: Federal-Mogul Ignition SRL, Milan (IT)

( * ) Notice: Subject to any disclaimer, the term of this patent is extended or adjusted under 35 U.S.C. 154(b) by 8 days.

(21) Appl. No.: 09/897,548

(22) Filed: Jul. 2, 2001

(65) Prior Publication Data

US 2002/0014939 A1 Feb. 7, 2002

(30) Foreign Application Priority Data

Jul. 28, 2000 (EP) ..... 00830539

(51) Int. Cl.[7] ..... H01F 27/02
(52) U.S. Cl. ..... 336/90; 336/92; 336/96
(58) Field of Search ..... 336/90, 92, 96; 123/634, 635

(56) References Cited

U.S. PATENT DOCUMENTS 3,563,334 A * 2/1971 McCarter
4,388,549 A * 6/1983 Bensman ..... 313/138
5,349,320 A * 9/1994 Suzuki et al. ..... 336/92
5,370,100 A 12/1994 Benedikt et al. ..... 123/654
5,411,006 A * 5/1995 Noble et al. ..... 123/634
5,419,300 A * 5/1995 Maruyama et al. ..... 123/634

FOREIGN PATENT DOCUMENTS

GB 2 252 454 A 8/1992
JP 05 172028 A 7/1993

* cited by examiner

*Primary Examiner*—Anh Mai
(74) *Attorney, Agent, or Firm*—Reising, Ethington, Barnes, Kisselle, Learman & McCulloch, P.C.

(57) ABSTRACT

An ignition coil for motor vehicles with a single output terminal comprises a body (16) carrying at one of its ends a flexible cap (18) provided with a seat (24) designed to receive an end (10) of a spark plug. The cap (18) comprises a high-voltage terminal (38, 40) electrically connected to the high-voltage winding of the coil and provided with a connection portion designed to receive a terminal (14) of the plug (10). A diode (26) is housed inside said cap (18) and is connected in series between two portions (38, 40) of said high-voltage terminal.

3 Claims, 1 Drawing Sheet

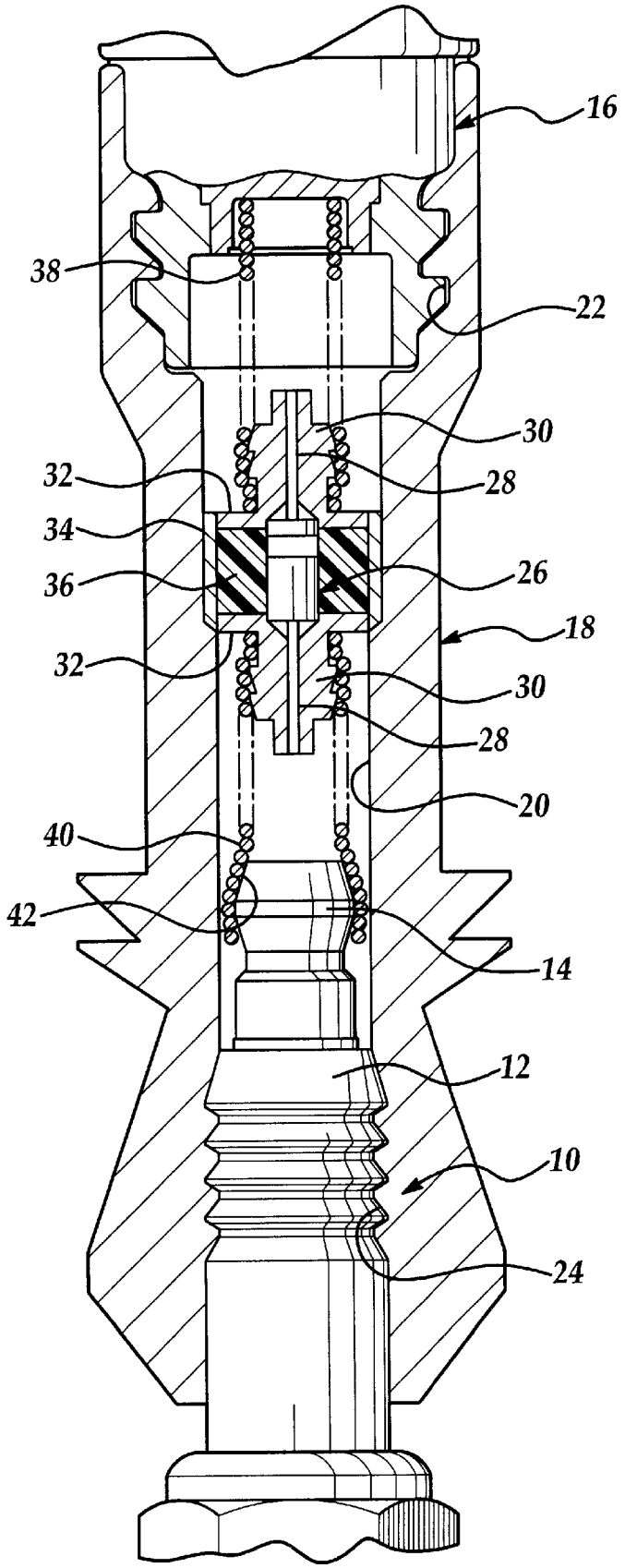
16
38
22
30
32
28
34
36
26
18
32
30
28
20
40
42
14
12
10
24

IGNITION COIL FOR VEHICLES

BACKGROUND OF THE INVENTION

The present invention relates to an ignition coil for motor vehicles, comprising a single output terminal, designed to be mounted directly on the end portion of a corresponding spark plug. Coils of this type comprise a body carrying at one end a flexible cap provided with a seat designed to receive the end of a spark plug. The cap comprises a high-voltage terminal electrically connected to the high-voltage winding of the coil and provided with a connection portion designed to receive a terminal of the plug.

Spark plugs of the type specified above, provided with a diode connected in series between the high-voltage winding and the high-voltage terminal of the coil are known. The use of a high-voltage diode in a single-output coil has the peculiar function of eliminating the overvoltages generated by the oscillations of the primary current at the start of the charging cycle. These overvoltages may cause undesired pre-ignition. In coils of the known type, the high-voltage diode is set inside the coil body.

The aim of the present invention is to provide an ignition coil of the type described above that is simpler from the constructional standpoint, more reliable, and of smaller dimensions than known coils.

SUMMARY OF THE INVENTION

According to the present invention the above purpose is achieved by an ignition coil having the characteristics that form the subject of the main claim.

BRIEF DESCRIPTION OF THE DRAWINGS

The present invention will now be described in detail with reference to the attached drawing, which is provided purely to furnish a non-limiting example and which shows an axial section of an end-portion of an ignition coil according to the invention, mounted on a spark plug.

DETAILED DESCRIPTION OF THE PREFERRED EMBODIMENT with reference to the drawing, the number 10 designates the top portion of a spark plug for internal-combustion engines of motor vehicles, which is provided, in a conventional way, with a ceramic body 12 from which a metal terminal 14 projects.

The reference number 16 designates an end portion of the body of an ignition coil for motor vehicles, of the type provided with a single output terminal and designed to be mounted directly on a corresponding spark plug. The body 16 of the ignition coil contains, in a way of itself known, a magnetic core around which are set a low-voltage primary winding and a high-voltage secondary winding (not illustrated). A flexible cap 18 made of elastomeric material or the like has a through cavity 20 and two seats 22, 24 designed to engage, respectively, the end portions of the body 16 and of the spark plug 10. Connection between the cap 18 and the end portions of the body 16 and of the spark plug 10 is obtained simply by interference, thanks to the deformability of the material of which the cap 18 is made.

In order to improve anchoring and seal, the engagement seats 22, 24 of the cap 18 may be provided, in a way of itself known, with annular grooves in which annular projections formed on the end portions of the coil body 16 and of the spark plug 10 engage.

A diode 26 is housed inside the through cavity 20 of the cap 18. The diode 26 has two rectilinear rheophores 28 which are fixed and electrically connected to respective electrical-connection elements 30. In the embodiment illustrated in the figure, the electrical-connection elements 30 have respective bases 32 which are connected together by an insulating tubular element 34 that defines a casing surrounding the diode 26 and is filled with an insulating resin 36. The diode 26 is connected in series between the high-voltage winding of the coil 16 and the terminal 14 of the spark plug 10. Preferably, this connection is obtained by means of two helical springs 38, 40 which constitute the high-voltage terminal of the coil 16. The first helical spring 38 is fixed, at one of its ends, to the end portion of the body of the coil and is electrically connected to the output terminal of the high-voltage winding (not illustrated) of the coil. A second end of the helical spring 38 is anchored to the corresponding connection element 30 of the diode 26. This anchoring is obtained simply by inserting the connection portion 30 inside the end portion of the helical spring 38. The elasticity of the spring guarantees mechanical and electrical connection between the spring 38 and the connection element 30. Likewise, the second helical spring 40 is anchored and electrically connected to the other connection element 30. The other end of the second spring 40 forms a connection portion 42 which is designed to receive the terminal 14 of the spark plug 10.

The solution according to the present invention enables simplification of the design of the coil. In fact, the insertion of the diode inside the high-voltage terminal makes it possible to design the coil without the constraints imposed by the presence of the diode inside the coil itself. The design of the diode and of the corresponding supporting assembly to be inserted into the cap 18 is made in a definitive way, irrespective of the type of coil. Consequently, there is a reduction in the design times. Industrialization and manufacture of the coil according to the invention are simpler than for known coils with diodes integrated in the coil body, in so far as it is not necessary to define, for each coil configuration, how to assemble, automate, and industrialize assembly of the diode. This results in a reduction in the investments for automatic assembly of the coil. The arrangement according to the invention moreover enables a reduction in the overall dimensions of the coil, in so far as the space occupied by the high-voltage terminal and by the cap is exploited for housing the diode. The fact that there are fewer components inside the coil makes it possible to increase the degree of reliability of the coil itself since a smaller number of processes for manufacturing the product reduces the possibility of error. The solution according to the invention may moreover be readily used in already existing products.

What is claimed is:

1. An ignition coil for motor vehicles with a single output terminal, comprising a body carrying at one of its ends a flexible cap provided with a seat designed to receive an end of a spark plug, said cap comprising a high-voltage terminal electrically connected to the high-voltage winding of the coil and provided with a connection portion designed to receive a terminal of the plug, the ignition coil comprising a diode housed inside said cap and connected in series between two portions of said high-voltage terminal.

2. A coil according to claim 1, wherein the high-voltage terminal comprises two helical springs anchored to respective electrical-connection elements that are fixed and electrically connected to respective rheophores of diode.

3. A coil according to claim 2, wherein the aforesaid electrical-connection elements are separated from one another by a tubular element defining a casing that surrounds the diode and is filled with an insulating resin.

* * * * *